US011389034B2

(12) United States Patent
Yu

(10) Patent No.: US 11,389,034 B2
(45) Date of Patent: Jul. 19, 2022

(54) SPLASH GUARD

(71) Applicant: Kohler Mira Limited, Cheltenham (GB)

(72) Inventor: Raymond Yu, Cheltenham (GB)

(73) Assignee: KOHLER MIRA LIMITED

( * ) Notice: Subject to any disclaimer, the term of this patent is extended or adjusted under 35 U.S.C. 154(b) by 0 days.

(21) Appl. No.: 17/178,499

(22) Filed: Feb. 18, 2021

(65) Prior Publication Data

US 2021/0169279 A1 Jun. 10, 2021

Related U.S. Application Data

(63) Continuation of application No. PCT/GB2019/052176, filed on Aug. 2, 2019.

(30) Foreign Application Priority Data

Aug. 31, 2018 (GB) ..... 1814216

(51) Int. Cl.
*A47K 3/36* (2006.01)

(52) U.S. Cl.
CPC ..... *A47K 3/36* (2013.01)

(58) Field of Classification Search
CPC ..... A47K 3/36; A47K 3/362
See application file for complete search history.

(56) References Cited

U.S. PATENT DOCUMENTS

| | | | | |
|---|---|---|---|---|
| 3,449,770 | A * | 6/1969 | Casebolt | A47K 3/36 4/607 |
| 5,222,261 | A | 6/1993 | Tooze et al. | |
| 9,027,177 | B2 * | 5/2015 | Perez | A47K 3/30 4/607 |
| 2013/0254984 | A1 | 10/2013 | Perez | |
| 2017/0202403 | A1 * | 7/2017 | Dozois | E05D 5/0246 |

FOREIGN PATENT DOCUMENTS

| | | |
|---|---|---|
| EP | 0 541 877 | 5/1993 |
| GB | 2 370 986 | 7/2002 |
| JP | 2000-328854 | 11/2000 |

OTHER PUBLICATIONS

Combined Search and Examination Report for GB1814216.6 dated Feb. 15, 2019; 5 Pages.
International Search Report PCT/GB2019/052176 dated Sep. 30, 2019; 2 Pages.

* cited by examiner

*Primary Examiner* — Janie M Loeppke
(74) *Attorney, Agent, or Firm* — Foley & Lardner LLP

(57) ABSTRACT

A bath screen for mounting on a rim of a bathtub includes a fixed part and a movable panel attached to the fixed part by one or more hinges. The bath screen also includes a channel member disposed at or near a lower corner or edge of the fixed part or the movable panel and extending beneath the one or more hinges, the channel member being arranged to collect water falling from above and to divert the collected water inboard of the one or more hinges.

20 Claims, 3 Drawing Sheets

SPLASH GUARD

CROSS-REFERENCE TO RELATED APPLICATIONS

This application is a Continuation of International Application No. PCT/GB2019/052176, filed Aug. 2, 2019, which claims the benefit of and priority to United Kingdom Patent Application No. 1814216.6, filed Aug. 31, 2018. The entire disclosures of International Application No. PCT/GB2019/052176 and United Kingdom Patent Application No. 1814216.6 are incorporated by reference herein.

BACKGROUND

This disclosure relates to splash guards or water containment devices such as water containment screens, in particular bath screens.

In a bathroom, a splash guard or a water containment device, e.g. a water containment screen, may be employed to help contain water within a specific area such as a bathtub or a shower tray. A water containment screen for containing water within a bathtub may be called a bath screen. A bath screen may be mounted on a rim of a bathtub, in order for example to contain water emitted from a shower arranged to be used by a user located within the bathtub.

A bath screen may comprise one or more panels. For instance, a bath screen may comprise a fixed panel and a movable panel attached to the fixed panel by one or more hinges. The provision of the movable panel effectively provides a door that allows for easier movement into and out of the bathtub. However, some water may leak between the fixed panel and the movable panel.

Any water that leaks between the movable panel and the fixed panel may fall on to an outboard region of the rim of the bathtub and subsequently may fall on to the floor.

SUMMARY

An exemplary embodiment relates to a bath screen for mounting on a rim of a bathtub. The bath screen includes a fixed part and a movable panel attached to the fixed part by one or more hinges. The bath screen also includes a channel member disposed at or near a lower corner or edge of the fixed part or the movable panel and extending beneath the one or more hinges, the channel member being arranged to collect water falling from above and to divert the collected water inboard of the one or more hinges. A kit of parts arranged to form such a bath screen may also be provided.

Another exemplary embodiment relates to a bath assembly that includes a bathtub and a bath screen mounted on a rim of the bathtub. The bath screen includes a fixed part and a movable panel attached to the fixed part by one or more hinges. The bath screen also includes a channel member disposed at or near a lower corner or edge of the fixed part or the movable panel and extending beneath the one or more hinges, the channel member being arranged to collect water falling from above and to divert the collected water inboard of the one or more hinges. A kit of parts arranged to form such a bath assembly may also be provided.

BRIEF DESCRIPTION OF THE FIGURES

The invention is described in further detail below by way of example and with reference to the accompanying drawings, in which.

DETAILED DESCRIPTION

Figure 1:
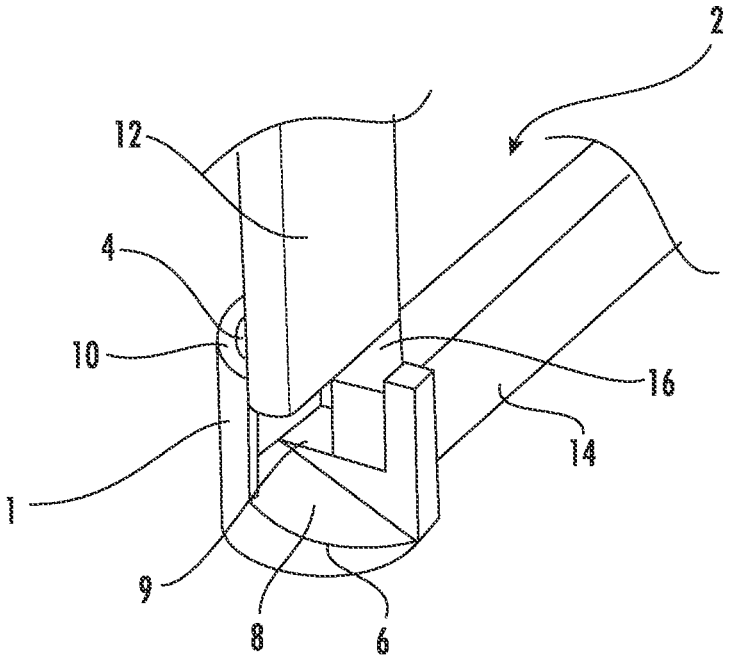
FIG. 1 shows a close-up perspective view of a channel member attached to a lower edge of a fixed panel of a bath screen.

A first aspect provides a bath screen for mounting on a rim of a bathtub comprising: a fixed part; a movable panel attached to the fixed part by one or more hinges; and a channel member disposed at or near a lower corner or edge of the fixed part or the movable panel and extending beneath the one or more hinges, the channel member being arranged to collect water falling from above and to divert the collected water inboard of the one or more hinges.

When mounted on the rim of a bathtub, the channel member acts to collect water falling from above and to divert the collected water into the bathtub. Accordingly, the bath screen of the present disclosure may help to alleviate the problem of water leakage between the fixed part and the movable panel.

The channel member may be configured to collect water falling from above on either side (outboard or inboard) of the one or more hinges. The channel member may be configured to collect water falling from above on both sides (outboard and inboard) of the one or more hinges.

The channel member may be adapted to be fixed to the fixed part at or near a lower corner of the fixed part.

The channel member may be adapted to be fixed to the moveable panel at or near a lower corner of the moveable panel.

The fixed part may comprise a post, a wall, a fixed panel or the like.

The movable panel and/or the fixed part, e.g. the fixed panel, may comprise an at least partially transparent material, e.g. glass or a polymeric material. The moveable panel and/or the fixed part, e.g. the fixed panel, may comprise one or more substantially non-transparent portions.

The bath screen may comprise one or more seal members. For example, a seal member may be provided on one or more edges of the fixed part and/or the moveable panel. One or more seal members may be attached to the fixed part and/or the moveable panel to provide a seal, e.g. a substantially watertight seal, between the fixed part and the moveable panel. The seal between the fixed part and the moveable panel may extend over a major portion of a height of the fixed part and/or the moveable panel. One or more seal members may be attached to a lower edge of the moveable panel to provide a seal, e.g. a substantially watertight seal, between the moveable panel and the rim of the bathtub.

The one or more seal members may comprise a polymeric material such as polyurethane.

The channel member may be attached or attachable to one or more of the seal members.

The channel member may comprise a water collection channel in fluid communication with an outlet disposed inboard of the one or more hinges. The water collection channel may pass underneath the one or more of the seal members attached to the fixed part and/or the moveable panel to provide the seal between the fixed part and the moveable panel The water collection channel may be sloping at least in part downwards towards the outlet. The water collection channel may comprise a substantially planar surface.

The water collection channel may comprise two or more regions having different gradients. For example, the water collection channel may comprise a first region that is substantially horizontal and a second region that slopes downwards towards the outlet.

The water collection channel may comprise a constant or varying gradient along a major portion of its length. The water collection channel may comprise a curved surface. The water collection channel may comprise an incline of up to or at least 1°, up to or at least 3°, up to or at least 5°, up to or at least 10°, up to or at least 20°, up to or at least 30°, or up to or at least 45°.

The channel member may comprise an inlet in fluid communication with the water collection channel. The inlet may be located outboard of the hinge(s). The inlet may be defined at least in part by a rim or an upper edge of the channel member. The inlet may be defined in part by an outboard surface of the fixed part, e.g. the fixed panel, and/or the moveable panel. The inlet may be defined in part by a surface of one or more of the seal members. The upper edge may be curved at least in part.

The channel member may comprise a plastics material. The channel member may comprise a metal. The channel member may comprise an alloy. The channel member may comprise a plurality of different materials, for example, a plastics material coated with a metal or an alloy. The channel member may comprise a chrome plated plastics material.

One or more of the seal members attached to the fixed part and/or the moveable panel to provide the seal between the fixed part and the moveable panel may extend downwards into the channel member. For instance, one or more of the seal members attached to the fixed part and/or the moveable panel to provide the seal between the fixed part and the moveable panel may have a lower end disposed below the rim or the upper edge of the channel member. The lower end of the seal member(s) attached to the fixed part and/or the moveable panel to provide the seal between the fixed part and the moveable panel may abut a surface of the channel member.

The fixed panel and/or the moveable panel may comprise a frame or may be frameless.

A second aspect provides a bath assembly comprising a bathtub and a bath screen according to the first aspect, wherein the bath screen is mounted on a rim of the bathtub.

The bath assembly may comprise a shower arranged to be used by a user located in the bathtub.

A third aspect provides a kit of parts arranged to form a bath screen according to the first aspect or a bath assembly according to the second aspect.

The person skilled in the art will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

Referring to FIG. 1, there is shown a lower portion of a fixed panel 2 of a bath screen for mounting on a rim of a bathtub. The fixed panel 2 may comprise a glass panel. A lower frame member 14 extends along a lower edge of the fixed panel 2. The lower frame member 14 may be mounted on the rim of the bathtub. A sealant may be employed to provide a seal between the lower frame member 14 and the rim of the bathtub. A seal member 12 is attached to a vertical edge of the fixed panel 2. The seal member 12 may extend along a major portion, e.g. substantially all, of a height of the fixed panel 2.

A channel member 1 is attached to a corner of the fixed panel 2 below the seal member 12. The channel member 1 comprises an inlet 4 and an outlet 6 with a water collection channel 8 extending therebetween. The water collection channel 8 passes underneath the seal member 12. The inlet 4 is located outboard of the seal member 12. The outlet 6 is located inboard of the seal member 12. The inlet 4 is defined by a curved rim 10 and the seal member 12. The water collection channel 8 comprises a sloping surface having a substantially constant gradient. The sloping surface slopes downwards towards the outlet 6. The channel member 1 comprises a ledge 9 adjacent the sloping surface of the water collection channel 8.

The channel member 1 may be made as a single piece, e.g. from a polymeric material such as an engineering plastic. The channel member 1 may be coated at least partially with a metal or alloy. An edge of the channel member 1 distal from the fixed panel 2 is curved, to facilitate movement of a moveable panel (not shown) hingedly attached to the fixed panel 2.

The seal member 12 may extend downwards into the channel member 1. A lower edge of the seal member 12 may be disposed below the curved rim 10. A lower edge of the seal member 12 may abut the ledge 9.

Figure 2:
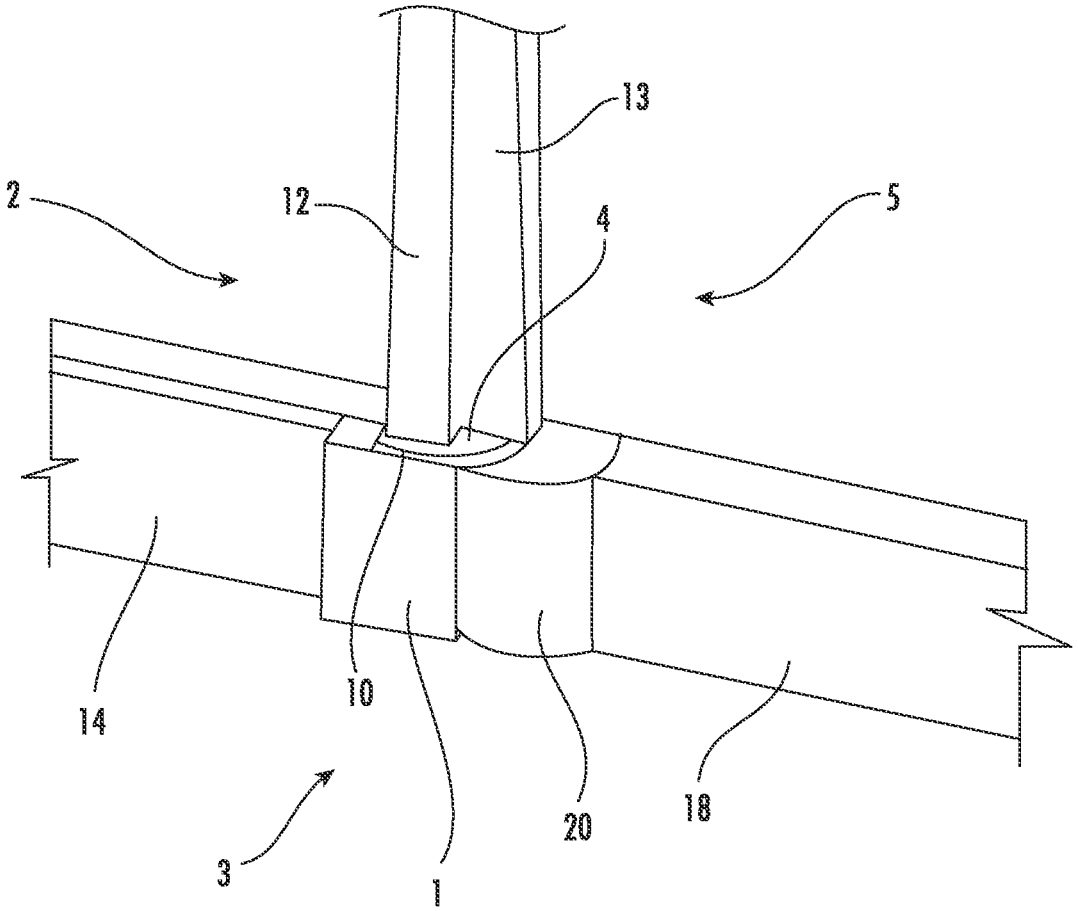
FIG. 2 shows a close-up view of a lower portion of a bath screen comprising a fixed panel, a moveable panel attached to the fixed panel by one or more hinges and a channel member.

Referring to FIG. 2, there is shown a lower portion of a bath screen 3 for mounting on a rim of a bathtub. The bath screen 3 comprises the features described above in relation to FIG. 1. The bath screen 3 further comprises a show moveable panel 5, which is attached to the fixed panel 2 by one or more hinges (not shown). The seal member 12 provides a seal between the fixed panel 2 and the moveable panel 5.

The moveable panel 5 may comprise a glass panel. The moveable panel 5 comprises a lower frame member 18. A seal member (not shown) may be attached to the lower frame member 18 to provide a seal between the lower frame member 18 and the rim of the bathtub. A seal member 13 is attached to a vertical edge of the moveable panel 5. The seal member 13 may extend along a major portion, e.g. substantially all, of a height of the moveable panel 5. The seal member 13 attached to the vertical edge of the moveable panel 5 and the seal member 12 attached to vertical edge of the fixed panel 2 together form a seal between the moveable panel 5 and the fixed panel 2.

A channel member seal 20 is attached to a lower corner of the moveable panel 5 and abuts the channel member 1. The channel member seal 20 is shaped to receive the curved edge of the channel member 1. The channel member seal 20 provides a seal with the channel member 1 to prevent, or at least reduce, the passage of water therebetween.

The channel member 1 is located beneath the seal members 12, 13 with the inlet 4 located outboard of the seal members 12, 13. The water collection channel 8 extends from the inlet 4 to the outlet 6, which is located inboard of the seal members 12, 13. Accordingly, the channel member 1 is arranged to collect water falling from above and to divert the collected water inboard of the one or more hinges.

Figure 3:
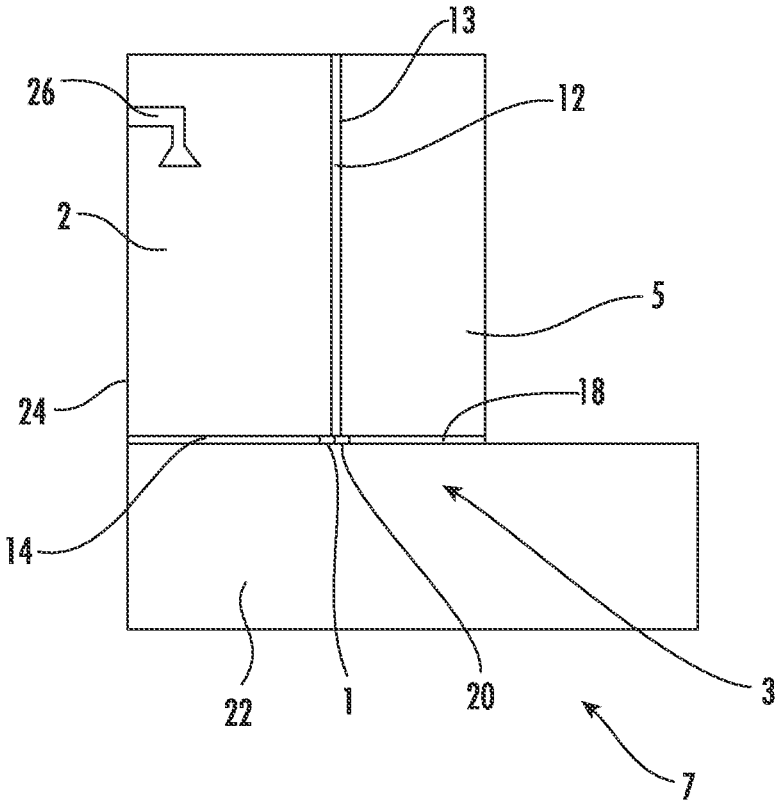
FIG. 3 shows a bath assembly.

FIG. 3 shows a bath assembly 7 comprising the bath screen 3 mounted on a rim of a bathtub 22. Like reference numerals have been used in FIG. 3 for like features shown in FIGS. 1 and 2 and described above.

The fixed panel 2 is attached to a wall 24 and extends a distance away from the wall 24 along the rim of the bathtub 22. A shower 26 is fixed to the wall 24. The shower 26 is arranged to be used by a user located in the bathtub 22.

In use, water from the shower 26 will splash on to the bath screen 3. Some water may leak between the seal members 12, 13. This water may then run down the outside of the seal members 12, 13. Water running down the outside of the seal members 12, 13 will be collected by the channel member 1 and diverted inboard of the one or more hinges such that the collected water may flow back into the bathtub 22. The channel member 1 also acts to collect water running down the inside of the seal members 12, 13 and to divert this collected water (further) inboard of the one or more hinges such that the collected water may flow back into the bathtub 22.

It will be understood that the invention is not limited to the embodiments above-described and various modifications and improvements can be made without departing from the concepts herein. Except where mutually exclusive, any of the features may be employed separately or in combination with any other features and the disclosure extends to and includes all combinations and sub-combinations of one or more features described herein.

What is claimed is:

1. A bath screen for mounting on a rim of a bathtub comprising:
- a fixed part;
- a movable panel attached to the fixed part by one or more hinges; and
- a channel member disposed at or near a lower corner or edge of the fixed part or the movable panel and extending beneath the one or more hinges, the channel member being arranged to collect water falling from above and to divert the collected water inboard of the one or more hinges;
- wherein the channel member comprises a water collection channel in fluid communication with an inlet and an outlet, the inlet and the outlet positioned in a substantially coaxial arrangement such that the inlet is on a first side of the movable panel or the fixed part and the outlet is on a second opposite side of the movable panel or the fixed part.

2. The bath screen of claim 1, wherein the channel member is configured to collect water falling from above on either or both sides of the one or more hinges.

3. The bath screen of claim 1, wherein the fixed part comprises a post, a wall, or a fixed panel.

4. The bath screen of claim 1, further comprising at least one seal member.

5. The bath screen of claim 4, wherein the at least one seal member is attached to at least one of the fixed part or the movable panel to provide a seal between the fixed part and the moveable panel.

6. The bath screen of claim 5, wherein the outlet is disposed inboard of the one or more hinges.

7. The bath screen of claim 6, wherein the water collection channel passes underneath the at least one seal member to provide the seal between the fixed part and the moveable panel.

8. The bath screen of claim 6, wherein the water collection channel slopes at least in part downwards towards the outlet.

9. The bath screen of claim 6, wherein the water collection channel comprises a gradient along a major portion of its length.

10. The bath screen of claim 6, wherein the inlet is located outboard of the one or more hinges.

11. The bath screen of claim 6, wherein the inlet is defined at least in part by a rim or an upper edge of the channel member.

12. The bath screen of claim 5, wherein the at least one seal member extends downwards into the channel member.

13. The bath screen of claim 12, wherein the seal abuts a ledge adjacent the water collection channel.

14. The bath screen of claim 4, wherein the inlet is defined by a curved rim and the at least one seal member.

15. A kit comprising: parts forming the bath screen of claim 1.

16. The bath assembly of claim 1, wherein the channel member is configured to collect water falling from above on either or both sides of the one or more hinges.

17. A bath assembly comprising:
- a bathtub; and
- a bath screen mounted on a rim of the bathtub, the bath screen comprising:
  - a fixed part;
  - a movable panel attached to the fixed part by one or more hinges; and
  - a channel member disposed at or near a lower corner or edge of the fixed part or the movable panel and extending beneath the one or more hinges, the channel member being arranged to collect water falling from above and to divert the collected water inboard of the one or more hinges;
  - wherein the channel member comprises a water collection channel in fluid communication with an inlet and an outlet, the inlet and the outlet positioned in a substantially coaxial arrangement such that the inlet is on a first side of the movable panel or the fixed part and the outlet is on a second opposite side of the movable panel or the fixed part.

18. The bath assembly of claim 17, further comprising a shower configured to be used by a user located in the bathtub.

19. The bath screen of claim 17, further comprising at least one seal member to provide a seal between the fixed part and the moveable panel.

20. A kit comprising: parts forming the bath assembly of claim 17.

* * * * *